United States Patent [19]

Mori et al.

[11] 4,384,876

[45] May 24, 1983

[54] PROCESS FOR PRODUCING KRYPTON AND XENON

[75] Inventors: Tatsuo Mori, Yokohama; Juichi Ishii, Sakura, both of Japan

[73] Assignee: Nippon Sanso K.K., Tokyo, Japan

[21] Appl. No.: 296,152

[22] Filed: Aug. 25, 1981

[30] Foreign Application Priority Data

Aug. 29, 1980 [JP] Japan ..... 55-119440

[51] Int. Cl.[3] ..... F25J 3/02

[52] U.S. Cl. ..... 62/22; 62/18; 62/40

[58] Field of Search ..... 62/18, 29, 22, 40, 30, 62/31

[56] References Cited

U.S. PATENT DOCUMENTS

| | | | |
|---|---|---|---|
| 3,222,878 | 12/1965 | Becker | 62/40 |
| 3,222,879 | 12/1965 | Stoklosinski | 62/41 |
| 3,509,728 | 5/1970 | Mercer et al. | 62/40 |
| 3,596,471 | 8/1971 | Streich | 62/29 |
| 3,768,270 | 10/1973 | Schuftan | 62/30 |
| 3,779,028 | 12/1973 | Schuftan et al. | 62/29 |

*Primary Examiner*—Norman Yudkoff

*Attorney, Agent, or Firm*—Darby & Darby

[57] ABSTRACT

A process for producing krypton and xenon in which relation to the air separation plant is restricted to receipt of liquid oxygen as raw material of krypton and xenon and return of liquid oxygen produced by the process. Heat which is necessary for rectification is provided by an argon recycle system.

6 Claims, 3 Drawing Figures

PROCESS FOR PRODUCING KRYPTON AND XENON

BACKGROUND OF THE INVENTION

This invention relates to a process for producing krypton and xenon in which liquid oxygen containing krypton and xenon in small concentrations accumulating in the main condenser evaporator of a conventional air separation plant is rectified to concentrate krypton and xenon, and particularly relates to a process producing krypton and xenon in which heat necessary for the rectification is provided by argon cycle whereby the whole system can be made compact and operation thereof can be easily performed.

In producing krypton and xenon, it is a normal procedure to concentrate liquid oxygen accumulating in the main condenser evaporator of the air separation plant by rectification to obtain liquid oxygen containing krypton and xenon in higher concentrations and to further rectify thus concentrated liquid to produce pure krypton and xenon gases. Referring to FIG. 1, in the above prior process the liquid oxygen extracted from the main condenser evaporator 1 is fed through line 2 to a first concentrating column 3 where it is rectified and then most of oxygen in the liquid is discharged from the top of the first concentrating column 3 through line 4 and concentrated liquid accumulates in a condensation section 5 at the bottom of the column 3. This rectification results in concentration of krypton and xenon, and also results in concentration of hydrocarbons contained in the liquid oxygen such as methane. Particularly, the enrichment of methane is liable to occur explosion. To avoid this explosion hazard, the concentrated liquid is vaporized by a heater 7 after flowing out through line 6 and then the vaporized hydrocarbons are burned in a catalytic combustion cylinder or reactor 8. Thereafter, the obtained vapor containing the combustion products are introduced through line 9 into one of a switchover-type adsorber 10 where water and carbon dioxide are removed by adsorption, the purified vapor is led through line 11 to a heat exchanger 12 where it is cooled, and is fed to a second concentrating column 14 by line 13, where the fed gas mixture is rectified. Oxygen gas is extracted by line 16 from the top of a condensation section 15 disposed at the top of the second concentrating column 14, and after cooling the gas mixture in the heat exchanger 12 it is withdrawn by line 17. At the bottom of the second concentrating column 14, there accumulates more concentrated liquid mixture of krypton and xenon, which is extracted by line 18 and introduced into conventional purifying and separating steps, in which krypton and xenon are separately recovered.

In the above process, gases separated by the air separation plant are usually used for imparting heat necessary for the rectification to recover krypton and xenon. For example, nitrogen gas is extracted as a heating source of the concentrating column 3 from the lower column of the air separation plant. The nitrogen gas is introduced by line 19 into the concentrating column 3 for reboiling where it is liquefied, and then the liquefied nitrogen is extracted and returned by line 20 to the air separation plant. To the second concentrating column 14 oxygen gas which has been separated by the air separation plant and then pressurized is fed through line 21, and generates upflowing gases therein. Furthermore, liquid oxygen obtained also from the air separation plant is usually supplied as a cooling source to a condensation section 15 of the second concentrating column 14 where it generates reflux liquid which is needed for rectification, and thereby liquid oxygen is vaporized. The vaporized gas is returned to the air separation plant by line 23. These heating and cooling units necessitate a system of a large number of long pipes connecting the krypton- and xenon-recovering plant to the air separation plant, and hence makes assemblage of the system greatly laborious. Furthermore, these units can afford disturbances to the air separation plant, and thereby causes the operation of the air separation plant to be unstable. Therefore, the application of the krypton- and xenon-recovering plant to air separation plants already built is not easily achieved according to the above prior heating process. In addition, the nitrogen gas as a heating source for rectification must be used at a relatively high pressure, i.e., about 5 atg. This requirement produces another disadvantage in pressure proof of the plant.

SUMMARY OF THE INVENTION

It is accordingly an object of the invention to provide a process for producing krypton and xenon in which krypton and xenon can be recovered without need of a large number of heating source supplying and returning pipes connecting to the air separation plant, so that assemblage of the pipes is easily completed.

It is a further object of the invention to provide a process for producing krypton and xenon in which only liquid oxygen is supplied by the air separation plant, thereby to eliminate or at least minimize the disturbance which will make the operation of the air separation plant unstable, and to enable the heating and cooling system to be applied to any krypton- and xenon-recovering plant, irrespective of the type, dimensions, etc. of the air separation plant.

It is another object of the invention to provide a process for producing krypton and xenon in which argon at relatively low pressure is used for heat source which is needed for rectification, thereby to save power necessary for the process and further to provide an advantage in pressure proof of the krypton- and xenon-recovering plant.

These and other objects are attained by a process for producing krypton and xenon in which relation to the air separation plant is restricted to at least receipt of liquid oxygen as raw material of krypton and xenon and the return of liquid oxygen produced by the krypton- and xenon-recovering process, and in which heat needed for rectification is provided by an argon recycle system.

DETAILED DESCRIPTION OF THE INVENTION

Figure 1:
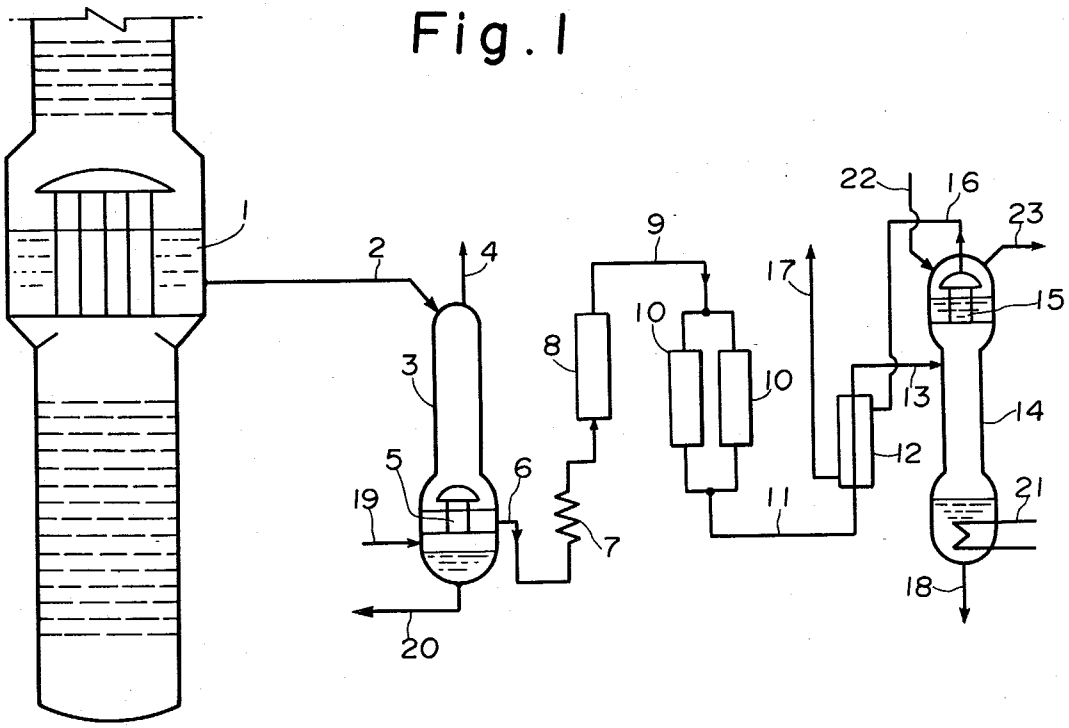
FIG. 1 is a flowsheet of the conventional process for producing krypton and xenon.

The present invention will be described with reference to FIGS. 2 and 3, in which the same parts as in FIG. 1 are given the same reference numerals, and explanation thereof is omitted.

Figure 2:
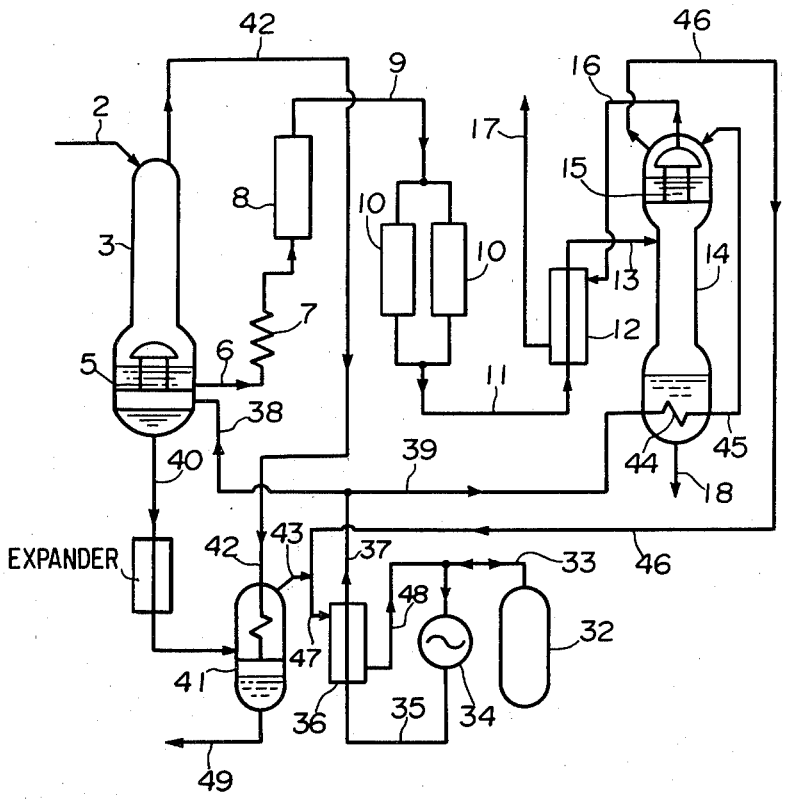
FIG. 2 is a flowsheet of a process for producing krypton and xenon according to the present invention.

Referring now to FIG. 2, argon gas stored in a buffer tank 32 is sucked through line 33 into a compressor 34, where it is compressed to 1.5 to 2.0 atg. Then the argon gas enters through line 35 a heat exchanger 36, where it exchanges heat with returned low temperature argon and is cooled to about −178° C. Thereafter, the cooled argon gas flows through line 37 which is branched into lines 38 and 39. Part of the argon gas flows through the branch line 38 into the bottom of the first concentrating column 3 where it heats the concentrated liquid to generate upflowing gas necessary for rectification, causing itself to be condensed and liquefied. The liquefied argon is extracted and introduced through line 40 into a condenser/vaporizer 41 to cool and liquefy the oxygen gas which has been fed from the top of the concentrating column 3 into the condenser/vaporizer 41 through line 42, and then vaporized argon flows out through line 43. The remaining argon gas flows through the branch 39 into a reboiler 44 of the second concentrating column 14 for heating where it is liquefied and then is introduced as cooling source into the condenser section 15 of the second concentrating element 14 by line 45. The liquid argon is vaporized by cooling the section 15, then the vaporized argon flows through line 46, joins the argon gas issuing from the condenser/vaporizer 41 through a line 43, and enters through a line 47 the heat exchanger 36 where it is heated. Thereafter the heated argon is sucked through line 48 into the compresser 34 and then recycled through the foregoing steps. The oxygen gas liquefied in the condenser/vaporizer 41 is extracted and returned back to the air separation plant by means of line 49.

Figure 3:
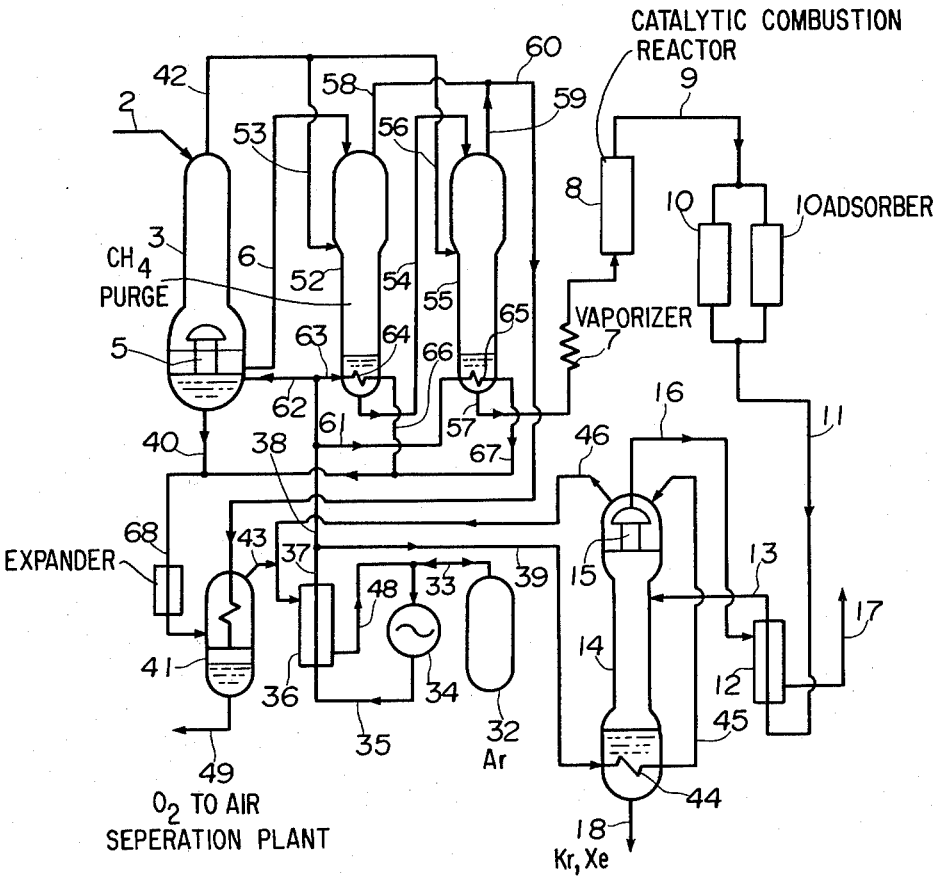
FIG. 3 is a flowsheet of another embodiment of the present invention.

FIG. 3 shows an application of the present invention to another plant for recovering krypton and xenon in which concentration of krypton and xenon is performed by rectification in a stepwise manner for enhancing highly safety in the plant and concentrations of krypton and xenon for facilitating later process thereof. Concentrated liquid which is accumulated in the condensed section 5 of the concentrating column 3 is extracted by line 6 and fed to the top of a first methane purging column 52, where while flowing downwards it is methane-purged by countercurrent contact with less methane contained oxygen gas which has been supplied from the top of the concentrating column 3 and injected through lines 42 and 53 to the middle stage of the methane purging column 52. This purging lowers greatly the concentration of the methane contained in the concentrated liquid, and the liquid is re-concentrated at lower part of this purging column 52. The re-concentrated liquid accumulated in the bottom of the methane purging column 52 is fed to the top of a second methane purging column 55 by means of line 54, where it is subjected to methane purging by countercurrent contact with the remaining less methane contained oxygen gas injected therein by line 56, and the methane purged liquid is re-concentrated at the lower part of the methane purging column 55. The re-concentrated liquid accumulated at the bottom of the column 55 flows out through line 57 and is conveyed to heater 7 where it is vaporized. The resulting gases are introduced as in the prior plant described in connection with FIG. 1 through catalytic combustion cylinder or reactor 8, adsorber 10, and heat exchanger 12 into second concentrating column 14. On the other hand, oxygen gas which has entrained methane in the first and the second methane purge columns 52 and 55 flows through lines 58 and 59, and then joins in line 60 which leads to the condenser/vaporizer 41. The purging oxygen gas used in the methane purge columns may be supplied from other oxygen sources, e.g., main air separation plant.

Now, the gaseous argon stream is, as in the system described in connection with FIG. 2, introduced through line 33, compressor 34, line 35 into heat exchanger 36 where it is cooled, and after flowing through line 37 it branches out into two streams flowing through lines 38 and 39. The branch stream flowing through line 38 further branches off, part of which flows through line 61 into a reboiler 65 of the second methane purging column 55 for heating the concentrated liquid, the remaining part of which branches off into two streams, one of which flows through line 62 into the first concentrating column 3 for heating, and the other of which flows through line 63 into a reboiler 64 of the first methane purging column 52 for heating. The other branch stream flowing through line 39 is, as described in connection with FIG. 2, conveyed to a reboiler 44 of the second concentrating column 14 where it is liquefied, and is then led by line 45 to the condensation section 15 for cooling this section, so that the liquid argon is vaporized and flows out through line 46 into heat exchanger 36. On the other hand, the argon which has been cooled or liquefied by heating the first concentrating column 3, and first and second methane purge column 52 and 55 flows out through lines 40, 66 and 67, respectively, and is led by line 68 to the condenser/vaporizer 41. The oxygen gas which has entrained methane by purging in the first and second methane purging column 52 and 55 is conveyed through line 60 to the condenser/vaporizer 41, where it is cooled and liquefied by the liquid argon introduced through line 68, and then thus liquefied oxygen-stream returns back to the air separation plant by line 49. The liquid argon introduced into the condenser/vaporizer 41 is vaporized by this cooling process, flows out through line 43, joins the vaporized argon flowing through line 46, and thus-joined gaseous argon is introduced into the heat exchanger 36 where it is heated. Thereafter, the gaseous argon is sucked in the compressor 34 through line 48 and then recycled.

In the above second embodiment, the methane purge process is performed by the use of two purge columns, but if desired, this process may be carried out by means of one or more than two methane purge columns.

The liquid oxygen produced in the condenser/vaporizer 41 may be stored in a liquid oxygen tank without returning to the air separation plant.

While the invention has been disclosed in specific detail for purposes of clarity and complete disclosure, the appended claims are intended to include within their meaning all modifications and changes that come within the true scope of the invention.

What is claimed is:

1. A process for producing krypton and xenon, comprising the steps of:

supplying to a first concentrating column liquid oxygen containing small concentrations of krypton, xenon, and hydrocarbons accumulating in a main condenser evaporator of an air separation plant;

rectifying the supplied liquid oxygen for separation into oxygen gas and concentrated liquid containing krypton, xenon and hydrocarbons;

vaporizing the concentrated liquid;

effecting combustion of the resulting vapor in a catalytic reactor;

removing products of the catalitic combustion by adsorption;

then rectifying the remaining vapor in a second concentrating column;

compressing argon gas;

cooling the compressed argon gas in a heat exchanger;

transporting part of the cooled argon gas to the first concentration column to heat the concentrated liquid, thereby liquefying the transported argon gas;

liquefying the said oxygen gas which separated at the first concentrating column by the use of the said liquefied argon gas in a condenser/vaporizer;

transporting the remaining argon gas to a reboiler of the second concentrating column in which the argon gas is liquefied, then vaporizing the liquefied argon in a condensation section of the second concentrating column;

transporting the resulting gaseous argon together with the argon gas vaporized in the condenser/-vaporizer to the heat exchanger and then recompressing the argon gas; and thereafter recycle the recompressed argon gas in the above steps.

2. A process as recited in claim 1, further comprising;

before the step of vaporizing the said concentrated liquid, introducing the said concentrated liquid into a methane purging column;

bringing the introduced concentrated liquid into countercurrent contact with oxygen gas, thereby purging methane contained in the concentrated liquid with the oxygen gas;

transporting part of the said cooled argon gas as heating gas to the methane purging column, where the argon gas is requefied; and liquefying the said oxygen gas entraining the purged methane from the methane purging column by the use of the said liquefied argon gas in the condenser/vaporizer.

3. A process as recited in claim 2, wherein oxygen gas issuing from the top of the concentrating column is supplied as oxygen gas for purging to the methane purging column.

4. A process as recited in claim 2, wherein the methane purging step is repeated in at least two methane purging columns.

5. A process as recited in claim 4, wherein the said concentrated liquid is re-concentrated in at least one of the methane purging columns after countercurrent contact with oxygen gas.

6. A process as recited in claim 2, wherein said concentrated liquid is re-concentrated in the methane purging column after countercurrent contact with oxygen gas.

* * * * *